US007013592B2

(12) United States Patent
Olson et al.

(10) Patent No.: US 7,013,592 B2
(45) Date of Patent: Mar. 21, 2006

(54) GUNS WITH EXTERIOR SURFACE CONFIGURED BARRELS

(75) Inventors: Douglas D. Olson, Vero Beach, FL (US); C. Reed Knight, Jr., Vero Beach, FL (US)

(73) Assignee: Knight's Armament Company, Titusville, FL (US)

( * ) Notice: Subject to any disclaimer, the term of this patent is extended or adjusted under 35 U.S.C. 154(b) by 316 days.

(21) Appl. No.: 10/693,181

(22) Filed: Oct. 27, 2003

(65) Prior Publication Data

US 2005/0229464 A1 Oct. 20, 2005

(51) Int. Cl.
*F41A 21/22* (2006.01)

(52) U.S. Cl. ..... 42/76.02; 89/14.05; 42/76.01

(58) Field of Classification Search ..... 42/76.01, 42/76.02, 57, 78; 89/14.05, 14.1, 125
See application file for complete search history.

(56) References Cited

U.S. PATENT DOCUMENTS

| | | | | | |
|---|---|---|---|---|---|
| D283,040 | S | * | 3/1986 | Holland et al. | D22/104 |
| D283,042 | S | * | 3/1986 | Holland et al. | D22/103 |
| 5,577,555 | A | * | 11/1996 | Hisajima et al. | 165/133 |
| 5,992,512 | A | * | 11/1999 | Tsuri et al. | 165/133 |
| 6,324,780 | B1 | * | 12/2001 | Behling | 42/78 |

* cited by examiner

*Primary Examiner*—Michael J. Carone
*Assistant Examiner*—Gabriel J. Klein
(74) *Attorney, Agent, or Firm*—Brian S. Steinberger; Law Offices of Brian S. Steinberger, P.A.

(57) ABSTRACT

Gas-operated automatic and semi-automatic guns are improved by providing their barrels with unique exterior surface configurations to reduce the weight of their barrels while retaining the barrels' original stiffness and to cause the barrels to dissipate heat faster.

10 Claims, 2 Drawing Sheets

GUNS WITH EXTERIOR SURFACE CONFIGURED BARRELS

BACKGROUND OF THE INVENTION

1. Field of the Invention

This invention relates broadly to gas-operated automatic and semi-automatic guns, especially rifles. More particularly, it concerns the improvement of such guns by addition of unique exterior surface configurations on their barrels.

2. Description of the Prior Art

There is a need to reduce the weight of guns that soldiers carry and an equally critical need to increase the endurance of the guns. Soldiers, especially those within the Special Operations Command, now fire their weapons much more than in the past and have actually gotten the guns so hot that projectiles will come thru the side of the hot barrels during prolonged gun battles. A serious problem gun designers must face, therefore, is how to both reduce the weight of barrels in guns without damaging their strength and also have them dissipate the heat faster so they can withstand as many as 500 rounds of continuous fire without a projectile exiting the side of the barrel.

It is known to create depressions in the outside walls of gun barrels to improve their strength, weight and accuracy, e.g., see U.S. Pat. No. 6,324,780.

It is also known that heat transfer through tube walls can be improved by creating rows of concave depressions on the outsides of the tube walls, e.g., see U.S. Pat. Nos. 5,577,555 and 5,992,512.

The present invention provides further advancements in weight reduction and heat release from barrels of gas-operated automatic and semi-automatic guns, especially rifles.

OBJECTS

A principal object of the invention is the provision of improvements in construction of gas-operated automatic and semi-automatic guns, especially rifles, by providing their barrels with unique exterior surface configurations.

Further objects include:

1. The modification of gas-operated automatic and semi-automatic guns to reduce the weight of their barrels while retaining the barrels' original stiffness.
2. The modification of gas-operated automatic and semi-automatic guns to make their barrels dissipate heat faster so the guns can withstand as many as 500 rounds of continuous fire without being destroyed by the projectiles moving thru the barrels.
3. The provision of improvements in guns that have particular application to the M16/M4 series of rifles.

Other objects and further scope of applicability of the present invention will become apparent from the detailed descriptions given herein; it should be understood, however, that the detailed descriptions, while indicating preferred embodiments of the invention, are given by way of illustration only, since various changes and modifications within the spirit and scope of the invention will become apparent from such descriptions.

SUMMARY OF THE INVENTION

The stated objects are accomplished in accordance with the invention by providing gas-operated automatic or semi-automatic guns with a barrel having a muzzle section defined by a muzzle peripheral surface and a breech section defined by a breech peripheral surface with unique exterior surface configurations on one or both of the peripheral surfaces of the muzzle and breech sections.

In accordance with the invention, the breech section and/or muzzle section of the gun barrel has a longitudinal portion P of its peripheral surface encircled with an array of concave depressions each defined by a depression opening, selected from circular openings and oblong openings, of predetermined area machined in the peripheral surface and by a predetermined maximum depth.

In preferred embodiments of the guns of the invention, the longitudinal portion P of its breech peripheral surface has a predetermined first peripheral surface area A1 before it is machined to reduce the weight and increase surface area. After machining, the total surface area of the longitudinal portion P of the barrel has a predetermined second peripheral surface area A2 that includes the remaining surface area of the longitudinal portion P and the combined surface areas of the concave depressions. The ratio A2/A1 advantageously is in the range 1.17 and 1.42 and this ratio depends upon the specifics of the barrel involved. This represents a 17% to 42% increase in the total surface area.

Where the concave depressions have circular openings all of the same size, the combined total surface area of the concave depressions A2CD is approximated by the equation $A2CD=N\times 2\pi RD$ wherein N is the total number of concave depressions, R is the approximate radius of the circular opening of the concave depressions and D is the average predetermined depth of the depression. The remaining surface area of the longitudinal portion LP of breech peripheral surface after the concave depressions are made is approximated by the equation $A2LP=(P\times C)-(N\times\pi R^2)$. The total surface area following the addition of the concave depressions is $A2=A2CD+2LP$. Similar computations can be made by those skilled in the art, particularly with the assistance of computers, for muzzles of the invention having oblong opening depressions or combinations of circular opening sizes or combinations of circular and oblong opening depressions.

When the muzzle section is provided with concave depressions of the invention, similar surface area data and ratios apply.

Further, in preferred embodiments, the predetermined maximum depth of the concave depressions is between about 42% and 54% percent of the thickness of the breech section measured at the longitudinal position of the relevant concave depression.

The concave depressions are created in accordance with the invention by use of ball end mills or equivalent circular machining tools of selected diameter to remove a circular or oblong depression through the barrel surface and into the gun barrel to the predetermined depth. Advantageously, the concave depressions are of equal size and are arranged in honeycomb fashion. Alternative arrangements include alternate rows of two size circular depressions, oblong depressions of one size, alternate rows of two size oblong depressions and alternate rows of oblong depressions with circular depressions.

BRIEF DESCRIPTION OF THE DRAWINGS

A more complete understanding of the invention can be obtained by reference to the accompanying drawings in which.

DESCRIPTION OF THE PREFERRED EMBODIMENTS

Figure 1:
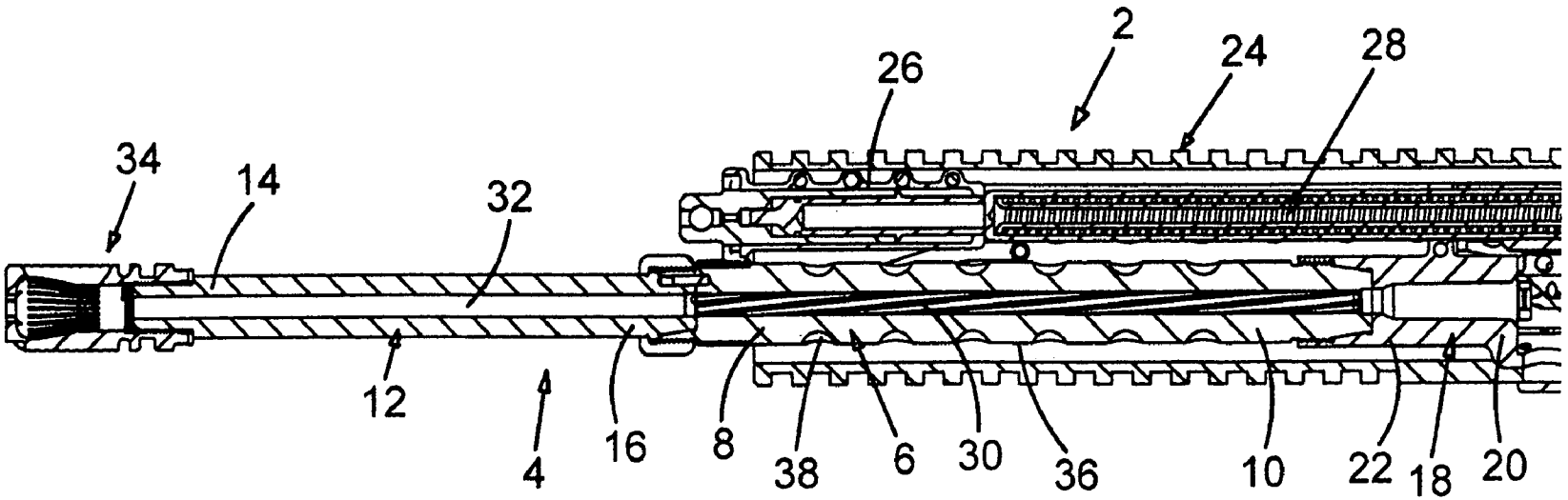
FIG. 1 is a sectional view of the left side of a gas operated automatic gun having a bisectional barrel with its breech section containing exterior surface configurations of the improved type provided by the invention.

Referring in detail to the drawings beginning with FIG. 1, the improved gun 2 of the invention comprises a barrel 4 having a breech section 6 defined by a breech front portion 8 and a breech rear portion 10 plus a demountable and interchangeable muzzle section 12 defined by a muzzle front portion 14 and a muzzle rear portion 16.

The gun 2 includes chamber 18 that is defined by a rear end 20 and front end 22. Chamber 18 is operatively connected at its front end 22 to breech rear portion 10.

The receiver 24 constitutes a major component of the gun 2. The rear end 20 of chamber 18 is operatively mounted to receiver 24 to accept ammunition therein in known fashion. Also, an actuation cylinder 26 is mounted to the receiver 24.

Located within the receiver 24 there is a mechanical system 28 operated by the actuation cylinder 26 to perform the gun functions of unlocking, extraction, ejection, feeding and relocking, The breech section 6 comprises a rifled bore 30 that extends forward from the front end 22 of the chamber 18 and the muzzle section 12 comprises a smooth bore 32.

An auxiliary muzzle attachment 34 is threaded onto the muzzle front portion 14.

Figure 2:
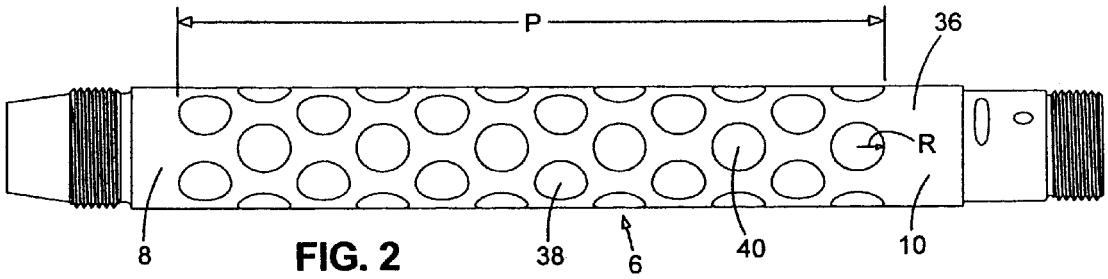
FIG. 2 is a side elevation view of breech section of the gun shown in FIG. 1.
Figure 3:
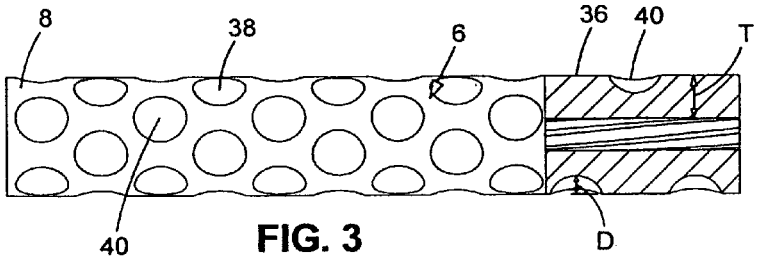
FIG. 3 is a side elevation of a portion of a gun barrel, with the right side partially shown in section, in accordance with the invention in which all the surface depressions therein are circular.

Referring now also to FIGS. 2 & 3, the breech section 6 of barrel 4 has a longitudinal portion P of its peripheral surface 36 encircled with an array of concave depressions 38 each defined by a circular opening 40 of predetermined area machined in the peripheral surface 36 and by a predetermined maximum depth D.

The longitudinal portion of breech peripheral surface 36 has a first peripheral surface area prior to the addition of concave depressions 38 of $A1=P\times C$, where P equals the length of the longitudinal portion P and C equals the average circumference of the peripheral surface 36 along distance P. The total surface area after the addition of concave depressions 38 is the combined total surface area of the concave depressions 38 plus the remaining surface area of the longitudinal portion of breech peripheral surface 36. The combined total surface area of the concave depressions A2CD is approximated by the equation $A2CD=N\times 2\pi RD$ wherein N is the total number of concave depressions 38, R is the radius of the spherical surface of concave depressions 38 and D is the average predetermined maximum depth of the concave depressions 38. The remaining surface area of the longitudinal portion of breech peripheral surface 36 after the concave depressions are machined is approximated by the equation $A2LP=(P\times C)-(N\times\pi R^2)$ wherein R is the approximate average radius of the openings of concave depressions 38 at surface 36. The total surface area following the addition of the concave depressions 38 is $A2=A2CD+A2LP$.

In preferred embodiments, the predetermined maximum depth D of the concave depressions 38 is between about 42% and 54% percent of the thickness T of the breech section measured at the longitudinal position of the relevant concave depression 38.

Figure 4:
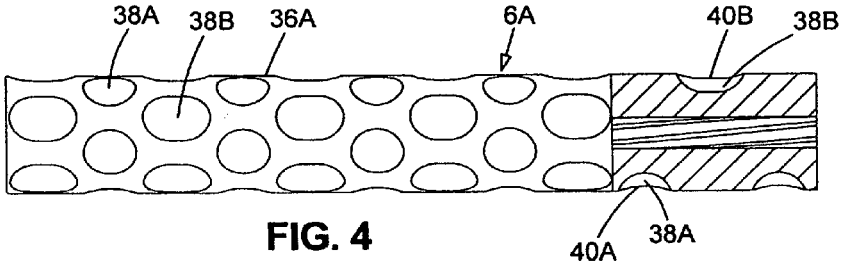
FIG. 4 is a side elevation of a portion of a gun barrel in accordance with the invention in which the surface depressions therein are a mixture of circular and oblong depressions.

Referring to FIG. 4, the breech section 6A has a portion of its peripheral surface 36A encircled with an array of concave depressions consisting of a mixture of circular concave depressions 38A each defined by a circular opening 40A of predetermined area machined in the peripheral surface 36A and oblong depressions 38B each defined by an oblong opening 40B of predetermined area machined in the peripheral surface 36A.

Figure 5:
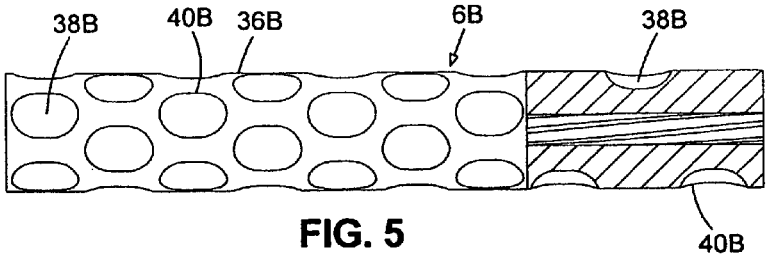
FIG. 5 is a side elevation of a portion of a gun barrel in accordance with the invention in which all the surface depressions therein are oblong.

Referring to FIG. 5, the breech section 6B has a portion of its peripheral surface 36B encircled with an array of oblong depressions 38B each defined by an oblong opening 40B of predetermined area machined in the peripheral surface 36B.

What is claimed is:

1. A gas-operated automatic or semi-automatic gun comprising a barrel having a breech section defined by a breech peripheral surface plus a muzzle section defined by a muzzle peripheral surface, said breech section having a longitudinal portion of said breech peripheral surface encircled with an array of concave depressions each defined by a depression opening, selected from circular openings and oblong openings, of predetermined area in said breech peripheral surface and of predetermined maximum depth, said longitudinal portion having a first peripheral surface area A1 before inclusion of said concave depressions and the combined surface areas of said concave depressions and the remaining surface area of said first peripheral surface area after inclusion of said concave depressions having a second peripheral surface area A2, and the ratio A2/A1 is between about 1.17 and 1.42.

2. The gas-operated gun of claim 1 wherein said concave depressions are circular tool machined and have circular openings.

3. The gas-operated gun of claim 2 wherein all said circular openings are of the same diameter.

4. The gas-operated gun of claim 1 wherein said concave depressions are circular tool machined and have oblong openings.

5. The gas-operated gun of claim 1 wherein said concave depressions are circular tool machined and are a mixture of circular openings and oblong openings.

6. The gas-operated gun of claim 1 wherein said muzzle section contains concave depressions with circular openings of two different sizes.

7. The gas-operated gun of claim 1 wherein said area A1 equals between about 70% and 95% of the area of said breech peripheral surface.

8. The gas-operated gun of claim 1 wherein said predetermined depth is between about 42% and 54% of the thickness of said breech section measured at the longitudinal position of said circular tool machined opening.

9. A gas-operated automatic or semi-automatic gun comprising a barrel having a breech section defined by a breech peripheral surface plus a muzzle section defined by a muzzle peripheral surface, said breech section having a longitudinal portion of said breech peripheral surface encircled with an array of circular concave depressions each defined by a circular opening of a predetermined area in said breech peripheral surface and by a predetermined depth, said longitudinal portion having a first peripheral surface area before inclusion of said concave depressions A1 and the combined surface areas of said concave depressions and the remaining surface area of said first peripheral surface area after the inclusion of said concave depression having a second peripheral surface area A2, and the ratio A2/A1 is between about 1.17 and 1.42.

10. A gas-operated automatic or semi-automatic gun comprising a barrel defined by a peripheral surface, said peripheral surface having a longitudinal portion thereof encircled with an array of circular tool machined concave depressions each defined by a depression opening, selected from circular openings and oblong openings, of predetermined area in said peripheral surface and of predetermined maximum depth, said longitudinal portion having a first peripheral surface area before inclusion of said concave depressions A1 and the combined surface areas of said concave depressions and the remaining surface area of said first peripheral surface area after inclusion of said concave depression having a second peripheral surface area A2, and the ratio A2/A1 is between about 1.17 and 1.42.

* * * * *